US006470900B1

(12) United States Patent
Hamilton

(10) Patent No.: US 6,470,900 B1
(45) Date of Patent: Oct. 29, 2002

(54) CRUTCH PLATFORM ATTACHMENT

(76) Inventor: Raymond A. Hamilton, 255 Lake George Rd., Seville, FL (US) 32190-7890

( * ) Notice: Subject to any disclaimer, the term of this patent is extended or adjusted under 35 U.S.C. 154(b) by 0 days.

(21) Appl. No.: 09/783,076

(22) Filed: Feb. 15, 2001

Related U.S. Application Data

(60) Provisional application No. 60/183,963, filed on Feb. 22, 2000.

(51) Int. Cl.[7] ..... A61H 3/02

(52) U.S. Cl. ..... 135/68; 135/66; 135/73; 135/71

(58) Field of Search ..... 135/65–66, 68, 135/71–73

(56) References Cited

U.S. PATENT DOCUMENTS

| | | | | | |
|---|---|---|---|---|---|
| 4,237,915 | A | | 12/1980 | Zabielski et al. | |
| 4,248,256 | A | * | 2/1981 | Thomas | 135/67 |
| 5,331,989 | A | * | 7/1994 | Stephens | 135/65 |
| 5,555,904 | A | | 9/1996 | Stockwell | |
| 5,564,451 | A | * | 10/1996 | Hagberg | 135/68 |
| 5,657,783 | A | * | 8/1997 | Sisko | 135/67 |
| 5,671,765 | A | | 9/1997 | Hagberg, Jr. | |
| 5,711,334 | A | * | 1/1998 | Roux | 135/65 |
| 5,845,664 | A | * | 12/1998 | Ryder | 135/65 |
| 5,860,439 | A | | 1/1999 | Ostertag | |
| 5,924,434 | A | * | 7/1999 | Cato | 135/68 |
| 5,983,912 | A | * | 11/1999 | Leu | 135/66 |
| 6,082,384 | A | * | 7/2000 | Cheng | 135/66 |
| 6,085,765 | A | | 7/2000 | Sigwworth | |

FOREIGN PATENT DOCUMENTS

| | | | | |
|---|---|---|---|---|
| FR | 2703246 | * | 7/1994 | 135/68 |

* cited by examiner

*Primary Examiner*—Beth A. Stephan
(74) *Attorney, Agent, or Firm*—Patent & Trademark Services; Thomas Zack; Joseph H. McGlynn

(57) ABSTRACT

A conventional crutch which has an attachment having a forearm support handled platform extending outwardly from the crutch. A stabilizer brace secured to the crutch's up rights receives the platform and a fold over covering tab on the brace may be used in conjunction with a stabilizer bar to provided increased strength to the held platform.

6 Claims, 3 Drawing Sheets

CRUTCH PLATFORM ATTACHMENT

This invention claims the benefit of the U.S. Provisional application No. 60/183,963 filed on Feb. 22, 2000.

BACKGROUND OF THE INVENTION

The present invention relates to an attachment to a conventional crutch to provide for a forearm support and which has a stabilizer brace secured to the crutch to receive a platform with a handle for the user.

Many types of attachments to crutches are known. For example, in one early invention a crutch with a forearm support and a carrying platform is disclosed. In another earlier invention, a crutch with a forearm platform at the upper end of the crutch and a telescoping leg is described.

Another prior art crutch is disclosed with a forearm platform at the upper end of the crutch.

Still another crutch related invention has a forearm support disposed at an angle from the upper end of the crutch.

One additional invention discloses a forearm crutch with an arm cradle cushion assembly.

DESCRIPTION OF THE PRIOR ART

Devices with attachments to conventional crutches are disclosed in the known in the prior art. For example, U.S. Pat. No. 4,237,915 to Zabielski et al. discloses a crutch with a forearm support and a carrying platform.

U.S. Pat. No. 5,555,904 to Stockwell discloses a crutch with a forearm platform at the upper end of the crutch and a telescoping leg.

U.S. Pat. No. 5,671,765 to Hagberg, Jr. discloses a crutch with a forearm platform at the upper end of the crutch.

U.S. Pat. No. 5,860,439 to Ostertag discloses a forearm support disposed at an angle from the upper end of the crutch.

U.S. Pat. No. 6,085,765 to Sigsworth discloses a forearm crutch with an arm cradle cushion assembly.

In the present invention a conventional crutch has a forearm support which has a stabilizer brace secured to the crutch which receives a platform with a handle all as will be detailed in the specification that follows hereafter.

SUMMARY OF THE INVENTION

This invention relates to a conventional crutch which has an attachment that includes a forearm support handled platform and a stabilizer brace secured to the crutch.

It is the primary object of the present invention to provide for an improved attachment to a conventional crutch wherein the attachment allows the user to remove all weight from their wrist and hand.

Another object is to provide for such an attachment that includes a separator brace, a platform with a handle all of which are mounted on a crutch.

A further object is to provide for such an attachment in which a stabilizer bar or strap is mounted to the separator brace and fixed to the vertical supports of the crutch.

These and other objects and advantages of the present invention will become apparent to readers from a consideration of the ensuing description and the accompanying drawings.

DESCRIPTION OF THE PREFERRED EMBODIMENT

Figure 1:
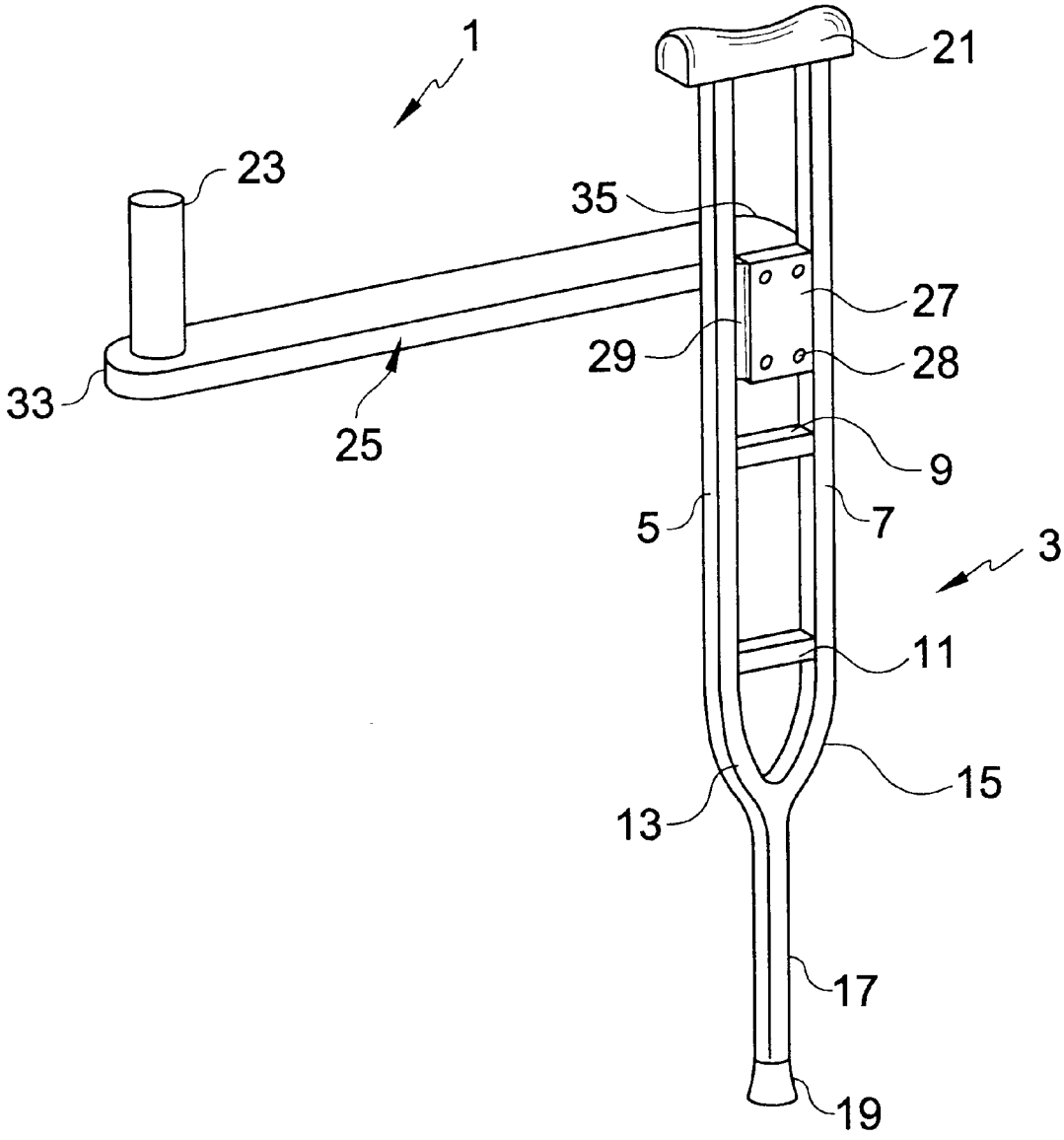
FIG. 1 is a perspective view of the present invention showing the attachment mounted to a conventional crutch.

FIG. 1 is a perspective view of the present invention showing the attachment 1 mounted to a conventional crutch 3. The crutch shown has two parallel upright members 5 and 7 that are disposed in a generally vertical disposition when the crutch is used. Connecting parallel cross members 9 and 11 to provide rigidity to the crutch's structure with the upper cross member 9 also providing a handle grip around which a user may place their hand. The lower converging sides 13 and 15 are joined together at their lower ends and fixed to a lower single base pole 17. A soft rubber or plastic ground/floor engaging end cap 19 may be used to provide increased friction. At the upper end of the crutch is a cushion pad 21 which is normally placed under the armpit of a user when the crutch is used.

With such a standard or conventional crutch the user's weight is distributed between their engaged armpit and the lower hand held cross member support 9. In the present invention, the user's weight is distributed between the arm pit engaging cushion pad 21 and the arm engaging attachment 1, thereby removing all user's weight from their wrist and hand on member 9.

Figure 3:
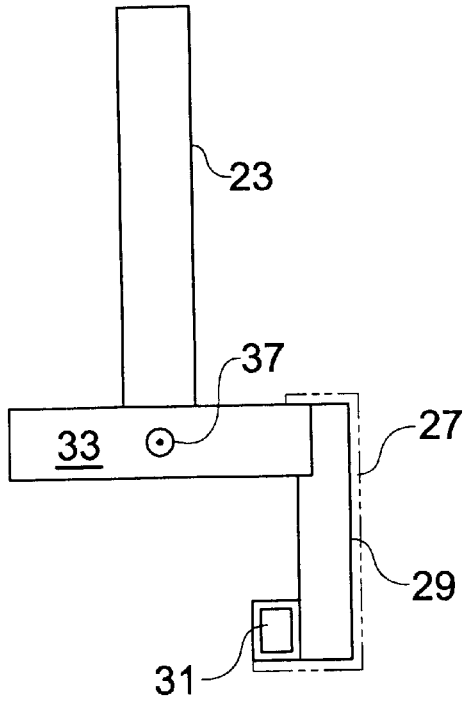
FIG. 3 is a front view of the attachment shown in FIG. 1 without the crutch.

In FIG. 1, the attachment's interconnected components consists of an upstanding handle guide 23, the elongated platform 25, a covering bent tab 27, a mostly covered separator brace 29 and a lower stabilizer bar 31 (not shown, see FIG. 3). As explained in more detail with regard to FIG. 4, this covering bent tab 27 forms a rectangular pocket which fits over most of the exposed surface area of the separator brace 29 to hold it in place.

Tab 27 extends along the facing exposed surface of brace 29 whose two side edges are just visible. Four screw fasteners 28 go through the tab 27 and into the covered brace 29 to hold them together as a unit. The separator brace 29 fits between the two crutch uprights 5 and 7 and extends to fill the space between them. This brace is fixed to the crutch's uprights by a screw which goes through the uprights and has an end wing nut fastener. The, not shown, lower stabilizer bar 31 is connected to and behind the separator brace 29. Bar 31 extends across the width of the lower portion of the brace. Bar 31 also fixed to the two spaced uprights 5 and 7 of the crutch and provides extra support for the engaged upper separator brace 29.

The arm supporting platform 25 is attached to the separator brace 29 and tab 27. Platform 25 is a planar sheet-like surface, like a piece of hardwood, that is much longer than its thickness or width with the width being greater than its thickness. For example, in one embodiment the platform was 17.25 inches long, had a width of 2.25 inches and a thickness of 0.75 inches. The platform extends outwardly from the crutch. The free end of the platform 33 away from the crutch and nearest the handle guide 23, is round in a half circle configuration about its width while the opposite platform end 35 near the attached crutch is rounded like in a quarter circle.

The upright handle guide extends through a drilled round opening in the platform and is secured by means of a set screw, as shown in FIG. 3. In same embodiment previously mentioned, the handle had a cylindrical shape with a diameter of 0.5 inches with a height of 5 inches up from the flat planar platform.

Figure 2:
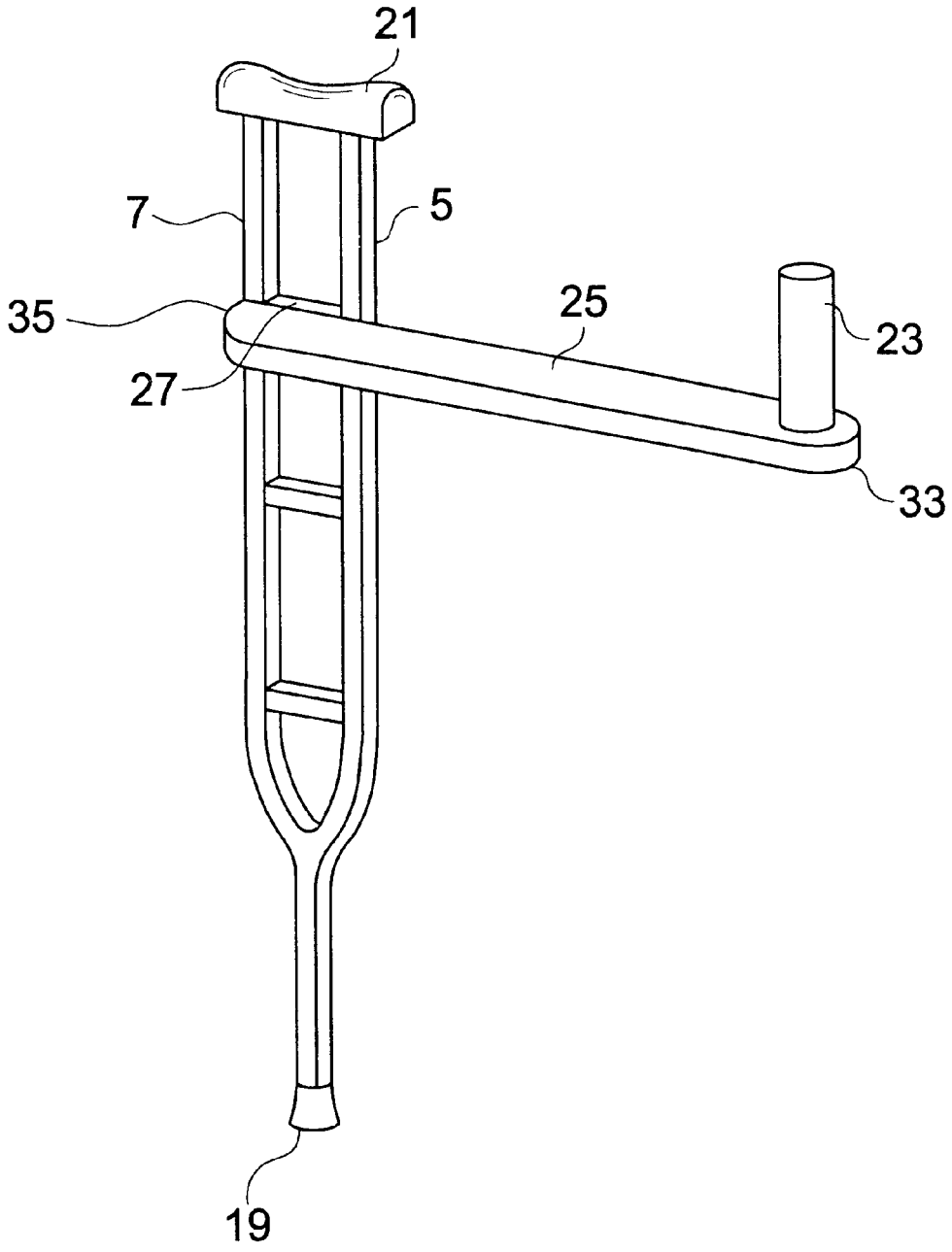
FIG. 2 is a top perspective view of the invention shown in FIG. 1.

FIG. 2 is a top perspective view of the invention shown in FIG. 1. In this view the two end platform curvatures, 33 and 35, are more clearly visible. The upper folded over edge of tab 27 is shown extending between the two crutch uprights 5 and 7 and over the edges of the brace 29 and the near edge of the platform. The mostly covered brace 29 actually engages the two crutch uprights and fills the space between them.

FIG. 3 is a front view of the attachment shown in FIG. 1 without the attached crutch 3. The covering tab 27 is shown in dotted line format covering most of the exposed surface of the brace 29 with two fold over edges that fit over the edges of the brace and adjacent edge of the platform. In this view the end of the stabilizer bar 31 is shown along the lower portion of the separator brace 29 to which it is fixed. Screws that go through the uprights 5 and 7 extend into the two opposite ends of bar 31 to fix it to the crutch. Also shown is a counter sunk hole 37 in platform's free end 33 having a screw whose head is shown. This screw extends to engage the portion of the handle 23 in the platform hole. This insures a firm fit between the upright handle and the lower supporting platform.

Figure 4:
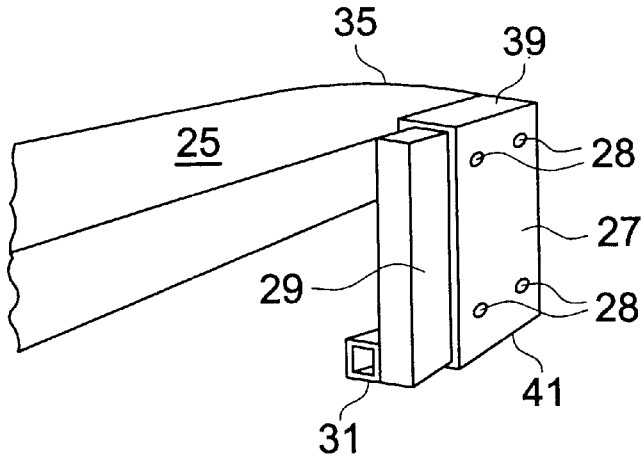
FIG. 4 is an enlarged perspective view of the bent tab used to hold the separator brace to the platform.

FIG. 4 is an enlarged perspective view of the bent tab 27 used to hold the separator brace 29 to the platform 25 (partially shown). The covering tab 27 has an upper folded over edge 39 and a similar lower edge 41. These two edges fit around the top and lower edges of the covered brace 29 whose two side edge surfaces are uncovered. Screws 28 that go through the tab extend into the brace 29 to fix these two members together. The lower tab folded over edge 41 extends over the thickness of the brace and may extend to the bar's (31) lower edge to also enclose it. The tab 27 could be welded to the platform to increase the fixed relationship between them.

In use, a person having difficulty walking would place their armpit under the crutch's upper cushion pad 21. However, using the attachment 1 most of their weight would not be placed on the armpit but on their elbows and lower arm region on the platform 25. Person restricted in using their hands and wrists, like those with Carpal Tunnel Syndrome, would be greatly aided by this invention due to the different weight distribution when used from conventional crutches.

The attachment 1 could be made in various sizes to fit individual users and could be made of metals such as aluminum, wood or a combination of metallic materials and natural materials. For example, the brace 29 could be wood, while the platform and handle made of aluminum. A stabilizer strap could be used in place of the stabilizer bar 31 to provide added support for the brace. If the user were left handed, the platform could be rotated 180 degrees to place the platform and handle on the side desired from that of a right handed user. Using strong light weight materials for the attachment is very desired.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. The combination of a crutch with an attachment comprising:

a crutch having upright members and an armpit engaging upper end;

a brace fixed to said upright members for supporting a platform;

a said platform fixed to said crutch and extending outwardly from said crutch, said platform providing an arm rest portion for a user whose armpit is placed over the armpit engaging upper end of the crutch; and a handle mounted on the platform extending in an upright direction from said platform to permit a user to grip the handle.

2. The combination as claimed in claim 1, wherein said brace has side surfaces and lower and upper edges, said brace also including a tab with fold over opposite edge portions to cover most of one side surface of the brace and the lower and upper edges.

3. The combination as claimed in claim 2, wherein said tab is retained to the brace by screws extending through the tab into the brace.

4. The combination as claimed in claim 3, also including a stabilizer bar mounted on said brace and extending to engage the upright members of the crutch.

5. The combination as claimed in claim 4, wherein said platform has a free end which is rounded and adjacent the handle.

6. The combination as claimed in claim 5, wherein said handle is mounted in a hole in the platform and held therein by a fastener extending into the platform.

* * * * *